United States Patent [19]

Kurosawa et al.

[11] Patent Number: 4,737,079

[45] Date of Patent: Apr. 12, 1988

[54] VARIABLE CAPACITY WOBBLE PLATE COMPRESSOR

[75] Inventors: Juetsu Kurosawa; Makoto Misawa, both of Konan, Japan

[73] Assignee: Diesel Kiki Co., Ltd., Tokyo, Japan

[21] Appl. No.: 25,497

[22] Filed: Mar. 13, 1987

[30] Foreign Application Priority Data

Mar. 19, 1986 [JP] Japan ..... 61-063402

[51] Int. Cl.[4] ..... F04B 1/26

[52] U.S. Cl. ..... 417/222; 417/223

[58] Field of Search ..... 417/222, 223

[56] References Cited

U.S. PATENT DOCUMENTS

| | | | |
|---|---|---|---|
| 4,393,966 | 7/1983 | Kono et al. | 417/223 |
| 4,526,516 | 7/1985 | Swain | 417/222 |
| 4,533,299 | 8/1985 | Swain | 417/222 |
| 4,543,043 | 9/1985 | Roberts | 417/222 |
| 4,586,874 | 5/1986 | Hinga et al. | 417/222 |
| 4,606,705 | 8/1986 | Parekh | 417/222 |
| 4,632,640 | 12/1986 | Terauchi | 417/222 |
| 4,655,689 | 4/1987 | Westueer et al. | 417/222 |

*Primary Examiner*—William L. Freeh

*Attorney, Agent, or Firm*—Frishauf, Holtz, Goodman & Woodward

[57] ABSTRACT

A variable capacity wobble plate compressor of the type that a wobble plate mounted on a drive shaft is swung axially of the drive shaft as the drive shaft rotates, and pistons connected to the wobble plate make reciprocating motions in response to swinging of the wobble plate, wherein a change in the angularity of the wobble plate causes a change in stroke of the reciprocating motions of the pistons whereby the capacity of the compressor is varied. A sensing element arranged on the wobble plate is moved along a predetermined orbital path together with swinging of the wobble plate. A sensor arranged on a compressor housing generates an electric signal when the sensing element passes by the sensor as the wobble plate swings. A control unit determines the rotational speed of the compressor and the angularity of the wobble plate on the basis of the electric signal from the sensor. The sensor is so located as to align with a predetermined location between an axial center of the predetermined orbital path of swinging of the sensing element and an extreme possible point toward the pistons, when the wobble plate assumes the minimum angularity.

8 Claims, 3 Drawing Sheets

VARIABLE CAPACITY WOBBLE PLATE COMPRESSOR

BACKGROUND OF THE INVENTION

This invention relates to a variable capacity wobble plate compressor for compressing refrigerant circulated within air conditioning systems for automotive vehicles, or the like.

Among conventional variable capacity wobble plate compressors of air conditioning systems for automotive vehicles, there is a type in which rotational speed sensor means detects a substantial difference between the rotational speed of an engine installed on the vehicle and the rotational speed of the compressor due to a defect in the compressor itself or in the clutch connecting between the compressor and the engine, and then the clutch becomes disengaged in response to a signal indicative of the detected speed difference to protect other auxiliary equipment driven by the engine via the same driving belt as the compressor.

According to this conventional compressor, the rotational speed sensor means is adapted to detect only the rotational speed of the compressor, but is not adapted to detect the angularity of the wobble plate. However, there is a demand for such rotational sensor means as is capable of detecting the angularity of the wobble plate as well as the rotational speed of the compressor, because such sensor means would prove to be useful in controlling the operation of the compressor. For example, if such dual-function sensor means is provided, it will be possible to compare the actual stroke amount of the pistons of the compressor with a desired preset value on the basis of signals from the sensor means indicative of detected compressor rotational speed and wobble plate angularity, and correct the piston stroke amount by the stroke amount difference so as to control the delivery quantity or capacity of the compressor to a desired value. Further, it will be also possible to check whether there is any abnormality in the compressor, on the basis of the signals from the sensor means.

SUMMARY OF THE INVENTION

It is an object of the invention to provide a variable capacity wobble plate compressor which is provided with sensor means capable of detecting the angularity of the wobble plate as well as the rotational speed of the compressor and thereby useful in controlling the operation of the compressor.

It is a further object of the invention to provide a variable capacity wobble plate compressor which is provided with sensor means capable of sensing both the wobble plate angularity and the compressor rotational speed, with a simple construction, thereby being low in manufacturing cost.

The present invention provides a variable capacity wobble plate compressor of the type including a housing, a drive shaft arranged in the housing, a wobble plate mounted on the drive shaft for swinging axially of the drive shaft as the drive shaft rotates, and pistons connected to the wobble plate for reciprocating motions in response to swinging of the wobble plate, wherein a change in the angularity of the wobble plate causes a change in stroke of the reciprocating motions of the pistons whereby the capacity of the compressor is varied.

A sensing element is arranged on the wobble plate at a predetermined peripheral portion thereof, and is moved along a predetermined orbital path together with swinging of the wobble plate. Sensor means is arranged on the housing for generating an electric signal when the sensing element passes by the sensor means as the wobble plate swings. Control means determines the rotational speed of the compressor and the angularity of the wobble plate on the basis of the electric signal from the sensor means. The sensor means is so located as to align with a predetermined location between an axial center of the predetermined orbital path of swinging of the sensing element and an extreme possible point toward the pistons, when the wobble plate assumes the minimum angularity.

Preferably, the control means calculates a first time interval from the time a first pulse of the electric signal is generated as the sensing element moves from a first region extending toward the piston from the axial center of the predetermined orbital path to a second region extending away from the pistons from the axial center to the time an immediately following pulse of the electric signal is generated as the sensing element moves from the second region of the first region, and a second time interval from the time a third pulse of the electric signal is generated as the sensing element moved from the second region to the first region to the time a further following pulse of the electric signal is generated as the sensing element moves from the first region to the second region, calculates the ratio between the first and second time intervals, and determines the angularity of the wobble plate from the calculated time interval ratio.

The above and other objects, features and advantages of the invention will be more apparent from the ensuing detailed description taken in conjunction with the accompanying drawings

Figure 1:
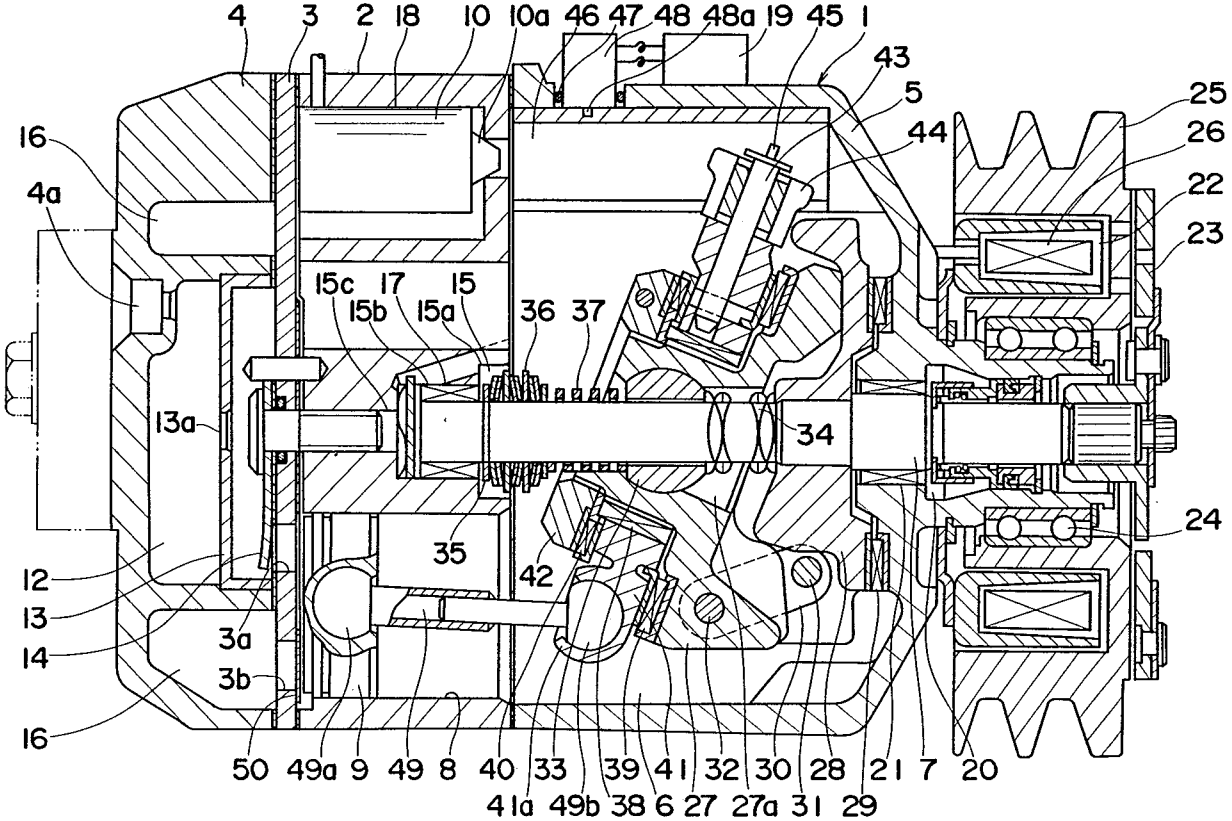
FIG. 1 is a longitudinal sectional view of a variable capacity wobble plate compressor according to an embodiment of the invention.
Figure 2A:
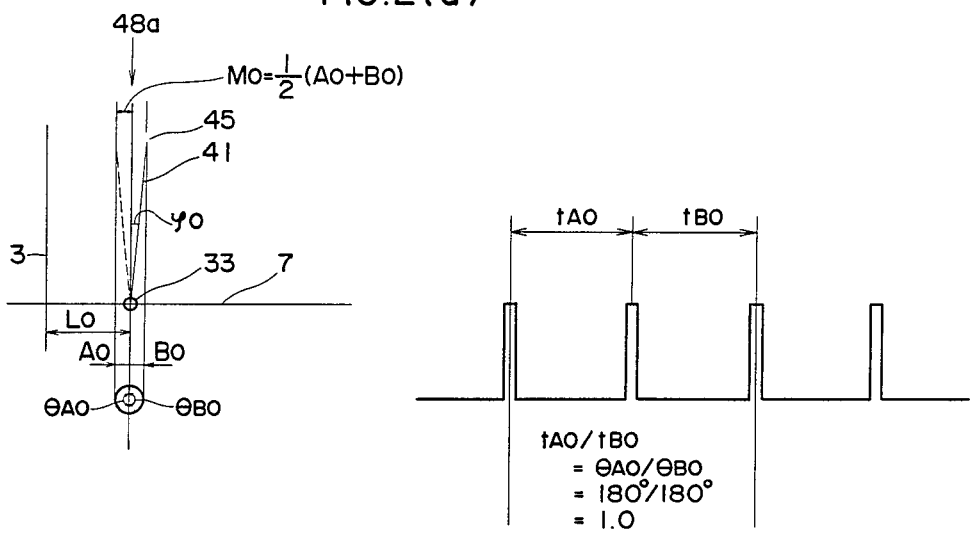
Figure 2B:
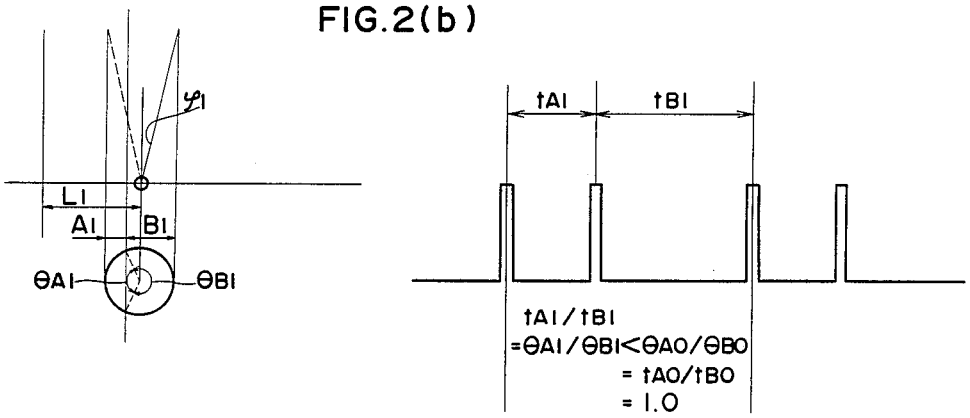
Figure 2C:
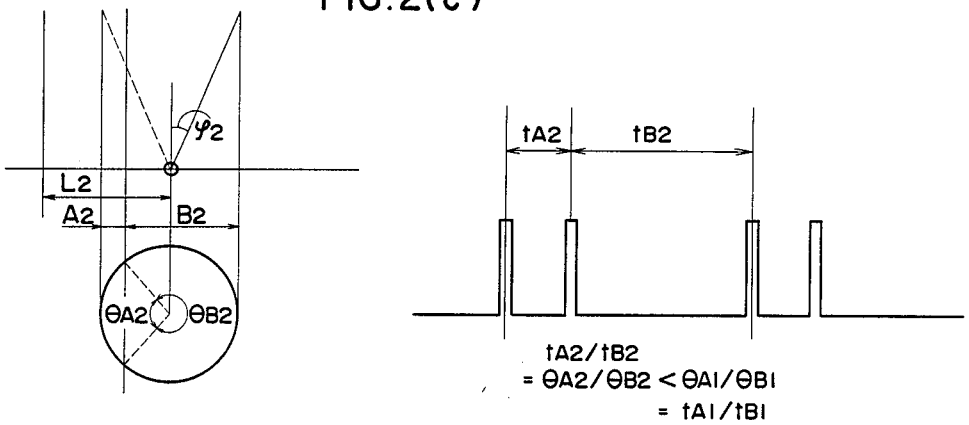

FIGS. *2a–2c* are diagrammatic views showing the relationship between the angularity of the wobble plate and output signal pulses from an electromagnetic induction type sensor appearing in FIG. 1, in the compressor according to the invention; and FIG. *3a* and FIG. *3b* are similar to FIG. 2, showing the same relationship obtained with the electromagnetic induction type sensor arranged at a different location from the sensor in FIG. 2.

DETAILED DESCRIPTION

The invention will now be described in detail with reference to the drawings showing a preferred embodiment thereof.

Referring first to FIG. 1, there is illustrated a variable capacity wobble plate compressor according to the invention. In the figure, reference numeral 1 designates a housing of the compressor, which is formed of a cylinder block 2, a cylinder head 4 secured in airtight manner to a left end face of the cylinder block 2 as viewed in FIG. 1 through a valve plate 3, and a head member 5 secured in airtight manner to the other end face of the cylinder block 2. A crankcase 6 is defined within the interior of the cylinder block 2 by an end face of the head member 5 of the cylinder block 2 facing toward the head member 5, and inner peripheral walls and an inner end wall of the head member. A drive shaft 7 is arraged within the housing 1 and extends substantially along the axis of the housing. A plurality of cylinders 8 are formed in the cylinder block 2 in circumferentially equally spaced relation and extend with their respective axes parallel with the axis of the drive shaft 7, and in each of which is slidably fitted a piston 9.

Formed in a left end face of the cylinder head 4 is a discharge port 4*a* through which compressed refrigerant gas is discharged. A discharge pressure chamber 12 is defined within the cylinder head 4 at a central portion thereof, in which is mounted a cover member 13 covering outlet ports 3*a* formed through the valve plate 3. The outlet ports 3*a* communicate with the discharge pressure chamber 12 via a through hole 13*a* formed through the cover member 13 at a central portion thereof. Mounted at the outlet ports 3*a* is a discharge valve 14 threadedly fitted in a thinned portion 15*c* of a central hole 15, hereinafter referred to, formed in the cylinder block 2. A suction chamber 16 is formed around the discharge pressure chamber 12 in the cylinder head 4, which communicates with the cylinders 8 through their respective inlet ports 3*b* formed through the valve plate 3. The inlet ports 3*b* are each provided with a suction valve 50.

The suction chamber 16 is communicated with the outlet of an evaporator, not shown, of the air conditioning system through a suction port, not shown, while the discharge pressure chamber 12 is communicated with the inlet of a condenser, not shown, of the air conditioning system, through the discharge port 4*a*.

The central hole 15 is formed in the cylinder block 2 at a central portion thereof, which comprises a thickened or large diameter portion 15*a*, a medium size portion 15*b* and the thinned or small diameter portion 15*c* successively and concentrically arranged in the mentioned order from the head member 5 toward the cylinder head 4. Fitted in the medium size portion 15*b* of the central hole 15 is a radial bearing 17 rotatably supporting the drive shaft 7.

A valve accommodating space 18 is formed in the cylinder block 2, in which is accommodated a pressure control valve 10. The pressure control valve 10 comprises a known normally open type electromagnetic valve, and is arranged between the discharge pressure chamber 12 and the crankcase 6 so as to control the degree of communication between the two chambers 12, 6. The pressure control valve 10 has its opening degree controlled by a control signal from a control unit 19 of the air conditioning system to thereby control the pressure within the crankcase 6.

The drive shaft 7 has an end portion toward the cylinder head 4 rotatably fitted in the medium size portion 15*b* of the central hole 15 via the bearing 17, while the other end portion toward the head member 5 is rotatably fitted in a central hole 20 in the head member 5 via a radial bearing 21. The end portion of the drive shaft 7 toward the head member 5 further extends through a projected portion of the head member 5 to the outside as an exterior extension on which an armature plate 23 of an electromagnetic clutch 22 is rigidly secured for rotation therewith. A pulley 25 is rotatably fitted on the projected portion of the head member 5 via a ball bearing 24, and has an outer side surface arranged opposite the armature plate 23. The pulley 25 is connected to a driving pulley on an output shaft of the engine, via a driving belt, none of which are shown. The electromagnetic clutch 22 has a solenoid 26 electrically connected to the control unit 19.

When the electromagnetic clutch 22 becomes engaged with its solenoid 26 energized by a control signal from the control unit 19, the armature plate 23 is magnetically attracted to the pulley 25 whereby rotation of the engine is transmitted to the drive shaft 7 through the electromagnetic clutch 22. On the other hand, when the electromagnetic clutch 22 becomes disengaged, the rotation of the engine is not transmitted to the drive shaft 7 whereby the pulley 25 runs idle.

A rotary retainer 28 is fitted on the drive shaft 7 at a location adjacent the head member 5 for transmitting the rotation of the drive shaft 7 to a wobble plate support member 27. The rotary retainer 28 is rotatably axially supported by the head member 5 via a thrust bearing 29. The rotary retainer 28 is joined to the wobble plate support member 27 by means of a link arm 30 pivotally joined to the both members 27, 28. To be specific, the link arm 30 has one end pivoted to a peripheral lower portion of the rotary retainer 28 and the other end to a peripheral lower portion of the wobble plate support member 27.

The wobble plate support member 27 has a central through hole 27*a* formed therein, in which the drive shaft 7 is freely fitted. A hinge ball 33, which is axially slidably fitted on an axially middle portion of the drive shaft 7, is slidably fitted in the central through hole 27*a* of the support member 27. Fitted on a portion of the drive shaft 7 between the hinge ball 33 and the rotary retainer 28 is a wave-shaped spring 34 urging the hinge ball 33 leftward as viewed in FIG. 1, i.e. toward the cylinder block 2. A stopper 35 is rigidly secured on an end of the drive shaft 7 located within the thickened portion 15*a* of the central hole 15. A plurality of leaf springs 36 and a coiled spring 37 are interposed between the stopper 35 and the drive shaft 7 and arranged in the mentioned order, urging the hinge ball 33 toward the head member 5 or rightward as viewed in FIG. 1.

A wobble plate 41 is mounted on the wobble plate support member 27 via a radial bearing 38 and thrust bearings 39 and 40 for rotation relative to the support member 27, the thrust bearings 39, 40 being secured to the wobble plate support member 27 by means of a bearing retaining plate 42. Each of the pistons 9 is pivotally joined to a peripheral edge portion of the wobble plate 41 by means of a piston rod 49 having opposite end balls 49*a*, 49*b* pivotally fitted in associated ends of the piston and the peripheral edge portion of the wobble plate 41. Thus, as the drive shaft 7 rotates to cause rotation of the rotary retainer 28 and the wobble plate support member 27, the wobble plate 41 is axially swung about the hinge ball 33 as described later, to cause the pistons 9 to make reciprocating motions within their respective cylinders 8 via the respective piston rods 49 whereby refrigerant gas is sucked and compressed.

A restraint pin 43 is inserted into an outer peripheral surface of the wobble plate 41 in a manner inwardly extending to a location close to the axis of the wobble plate. A plate-like slipper 44 is rotatably fitted on a radially outer end portion of the restraint pin 43, and a sensing pin 45 as a sensing element is rigidly inserted into a central portion of the outer end face of the restraint pin 43.

A pair of parallel guide plates 46, only one of which is shown, are affixed to an inner peripheral surface of the housing 1 facing the slipper 44 and axially extend from the end face of the cylinder block 2 facing toward the head member 5 to an opposed inner surface of the head member 5. Thus, the restraint pin 43, slipper 44 and pin 45 are moved along a channel defined between the guide plates 46 together with swinging motion of the wobble plate 41. That is, the wobble plate 41 is prohibited from making circumferential movement relative to the drive shaft but is allowed to make axially swinging motion about the hinge ball 33 in a direction parallel with the axis of the drive shaft 7. With a change in the angularity of the wobble plate 41, the hinge ball 33 is moved axially of the drive shaft 7 due to the action of the link arm 30 to assume a position corresponding to the angularity of the wobble plate such that it assumes a position increassingly remote from the pistons 9 as the angularity of the wobble plate 41 increases.

A sensor 48 is mounted on an outer peripheral surface of the housing 1 in a manner embedded therein via an O-ring 47. This sensor 48 is a known electromagnetic induction type, which may be formed of a sensing probe 48*a* formed of a magnet, and a coil, not shown, for example. The sensor 48 is so located that its sensing probe 48*a* corresponds in circumferential position to an orbital path along which the pin 45 is swung, and corresponds in axial position to an axial center of the above orbital path obtained when the wobble plate 41 assumes the minimum angularity, that is, the sensing probe 48*a* is located right above the hinge ball 33. The electromagnetic induction type sensor 48 generates a signal pulse each time the pin 45 passes by the sensing probe 48*a*, which pulse is supplied to the control unit 19.

Since the sensing probe 48*a* of the sensor 48 is located at the above-mentioned position, it is possible to calculate the angularity of the wobble plate 41 directly from the time interval ratio of generation of signal pulses from the sensor 48. FIG. 2 shows the relationship between the angularity of the wobble plate 41 and the time interval ratio of generation of signal pulses. As the drive shaft 7 rotates, the wobble plate 41 is axially swung about the hinge ball 33 along a predetermined orbital path in the form of a sine curve symmetrical with respect to the hinge ball 33. If in FIG. 2 the left-hand region with respect to the sensing probe 48*a* of the sensor 48 is designated by A, and the right-hand region by B, each time the pin 45 as the object to be sensed passes by the sensing probe 48*a*, that is, each time the pin 45 moves from the region B to the region A or vice versa, the sensor 48 generates a signal pulse. Thus, during one cycle of swinging motion of the wobble plate in which the pin 45 moves from the region B to the region A and then returns from the region A to the region B, two signal pulses are generated. If the time interval from the time a signal pulse is generated when the pin 45 shifts from the region B to the region A to the time another signal pulse is generated when the pin 45 shifts from the region A to the region B, that is, the time period during which the pin 45 stays within the region A, is designated by tA, and the time interval from the time the pin 45 shifts from the region A to the region B to the time the pin moves from the region B to the region A, that is, the time period during which the pin 45 stays within the region B, is designated by tB, tA is proportionate to an angle of rotation $\theta A$ of the drive shaft 7 corresponding to the region A, and tB is proportionate to an angle of rotation $\theta B$ corresponding to the region B, provided that the rotational speed of the drive shaft 7 is constant during one cycle.

(a) of FIG. 2 shows a state in which the angularity $\psi$ of the wobble plate 41 assumes the minimum value $\psi 0$. In this state, the hinge ball 33 assumes the leftmost position as viewed in FIG. 1, at a distance L0 from the right end face of the valve plate 3 in FIG. 1. Then, since the sensing probe 48*a* is located at a position corresponding to the axial center of the orbital path of movement of the pin at the minimum angularity of the wobble plate as noted before, the pin 45 makes a swinging motion in a symmetrical fashion with respect to the sensing probe 48*a*. Thus, in this minimum angularity position, the time interval ratio of generation of signal pulses, i.e. tA/tB assumes a value $tA0/tB0=1$.

When the angularity $\psi$ of the wobble plate 41 increases to a value $\psi 1$ ($\psi 1>\psi 0$), the hinge ball 33 is rightwardly moved as viewed in FIG. 1 to a position corresponding to $\psi 1$ by the action of the link arm 30, wherein the distance from the right end face of the valve plate 3 assumes a value L1 ($L1>L0$). In this position wherein the hinge ball 33 has been rightwardly moved in FIG. 1 and the distance L1 corresponds to the angle of rotation $\psi 1$, the length A1 of the orbital path of the pin 45 within the region A is shorter than the length B1 of the orbital path within the region B so that the ratio A1/B1 is less than 1. Accordingly, the rotational angle ratio $\theta A1/\theta B1$ assumes a value less than 1 and the time interval ratio tA1/tB1 assumes a value equal to $\theta A1/\theta B1$.

As the angularity $\psi$ of the wobble plate 41 further increases ($\psi=\psi 2$, $\psi 2>\psi 1$), the hinge ball 33 is moved to a more rightward position ($L=L2$, $L2>L1$), so that the ratio A2/B2 between the length of the orbital path within the region A and the length of the orbital path within the region B assumes a smaller value, and accordingly, tA2/tB2 assumes a correspondingly smaller value.

As stated above, according to the present embodiment, two signal pulses are generated per cycle of swinging of the wobble plate irrespective of the angularity of the wobble plate 41 assumed, and the time intervals of signal pulse generation tA, tB always satisfy the relationship of $tA \leqq tB$, whereby the time interval ratio of signal pulse generation tA/tB varies in a direction corresponding to the direction of a change in the angularity of the wobble plate 41. Thus, by detecting the time intervals of signal pulse generation tA, tB, it is possible to determine the angularity $\psi$ of the wobble plate 41 and accordingly the delivery quantity or capacity of the compressor.

Although in the present embodiment the sensing probe 48*a* of the electromagnetic induction type sensor 48 is so located as to align with the axial center of the orbital path of swinging motion of the pin 45 when the wobble plate 41 assumes the minimum angularity, this is not limitative, but the sensing probe 48*a* may be so located as to align with any other position between the axial center of the orbital path of the pin 45 and an extreme possible position toward the pistons 9 at the minimum angularity of the wobble plate 41, providing similar results to those obtained by the present embodiment. According to such alternative arrangement, although as compared with the present embodiment the time interval ratio tA/tB assumes smaller values, the wobble plate angularity can be determined directly from the ratio tA/tB which also varies in a direction corresponding to the direction of a change in the wobble plate angularity.

Figure 3A:
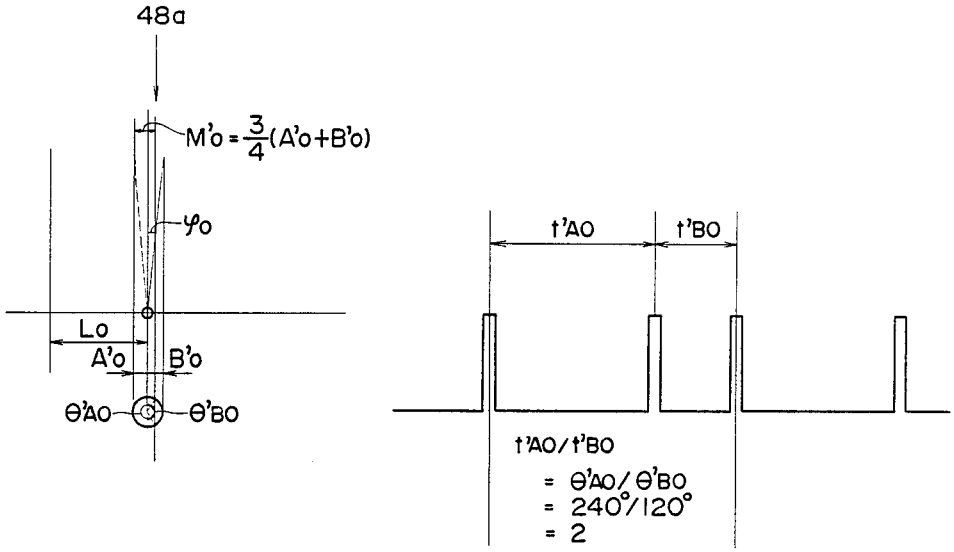
Figure 3B:
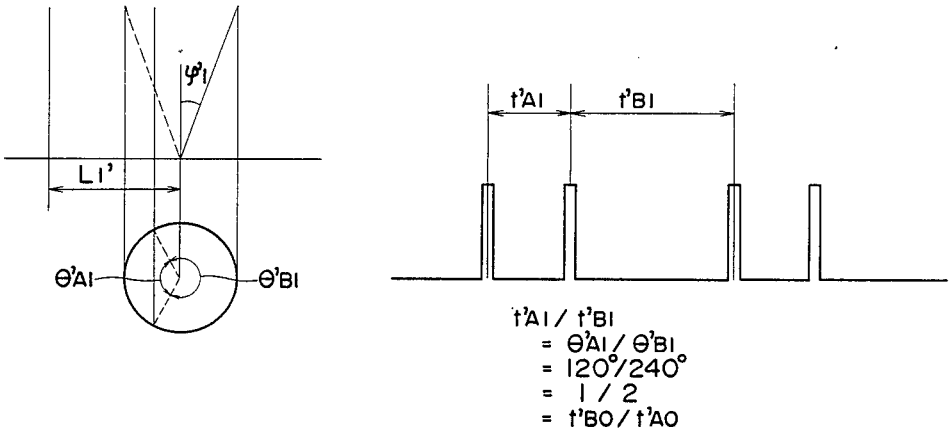

On the other hand, in an arrangement that the sensing probe 48*a* is so located as to align with a position between the axial center of the orbital path of swinging of the pin 45 and an extreme possible position remote from the pistons 9 at the minimum angularity of the wobble plate 41, the wobble plate angularity $\psi$ and the time interval ratio tA/tB do not vary in direction corresponding to each other. FIG. 3 is useful in explaining the reason for this, which shows an example in which the sensing probe 48*a* is so located as to align with a bisector between the axial center of orbital path of the pin 45 and the extreme possible point remote from the pistons 9 at the minimum angularity of the wobble plate 41.

In FIG. 3, (a) shows a state in which the angularity $\psi$ of the wobble plate 41 assumes the minimum angularity $\psi 0$, with the sensing probe 48*a* located at a different point as mentioned above from that in (a) of FIG. 2. In this state, the ratio A'0/B'0 between the orbital path length A'0 of the pin 45 within the region A and the length B'0 within the region B is equal to 3, and accordingly the time interval ratio of signal pulse generation t'A0/t'B0 is equal to 2.

As the angularity $\psi$ of the wobble plate 41 increases so that the hinge ball 33 is moved rightward as viewed in FIG. 1, the sensing probe 48*a* becomes located at the bisector between the axial center of orbital path of the pin 45 and the extreme possible point toward the pistons 9. In this position, the pin 45 and the sensing probe 48*a* are in axially reverse positional relation to each other as compared with (a) of FIG. 3 wherein the wobble plate angularity assumes the minimum value. As a result, the orbital path length A'1 of the pin 45 within the region A and the length B'1 within the region B are in a ratio A'1/B'1 equal to $\frac{1}{3}$, and accordingly the time interval ratio of signal pulse generation tA'1/tB'1 is equal to $\frac{1}{2}$. The reciprocals of these ratios are equal, respectively, to A'0/B'0 and t'A0/t'B0 obtained at the position of (a) of FIG. 3. However, it is impossible to judge from the signal pulses generated by the sensor 48 the direction in which the pin 45 has been swung, that is, whether the pin 45 has moved from the region A to the region B or in the reverse direction, at the time of generation of a signal pulse. That is, the signal pulses shown in (a) and (b) of FIG. 3 give rise to the same time interval ratio, although the angularity $\psi$ of the wobble plate 41 assumes different values between (a) and (b) of FIG. 3. Thus, the wobble plate angularity $\psi$ and the time interval ratio of signal pulse generation are not in definite relation to each other, making it impossible to determine the angularity $\psi$ of the wobble plate 41 from the time interval ratio of signal generation. A similar situation occurs without exception when the sensing probe 48*a* is so located as to align with any other point than the bisector between the axial center of the orbital path of the pin 45 and the extreme possible point remote from the pistons 9 at the minimum angularity of the wobble plate 41. Therefore, according to the invention the set position of the sensing probe 48*a* is limited to a location between the axial center of the orbital path of the pin and the extreme possible point toward the pistons 9 at the minimum angularity of the wobble plate 41.

The control unit 19 is adapted to calculate the rotational speed of the compressor from the number of signal pulses generated by the sensor 48 within a predetermined period of time, and also the angularity of the wobble plate 41 from the time interval ratio of signal pulse generation, respectively. The control unit 19 has stored therein a rotational speed table of predetermined values of compressor rotational speed versus engine rotational speed, and an angularity table of predetermined angularity values versus various parameters such as fresh air temperature and recirculated air temperature. Electrically connected to the control unit 19 are an engine rotational speed sensor, and various parameter sensors for sensing the various parameters, sensed values of which are supplied to the control unit 19. The control unit 19 determines a predetermined value of compressor rotational speed on the basis of the sensed engine rotational speed by the use of the above rotational speed table, and compares the predetermined compressor speed value thus determined with the sensed compressor speed value determined from the above number of signal pulses generated from the electromagnetic induction type sensor 48 to determine whether or not the rotational speed of the compressor is normal. When an abnormality is detected in the compressor rotational speed, the control unit 19 supplies the electromagnetic clutch 22 with a signal commanding disengagement thereof to thereby protect other auxiliary equipments driven by the same driving belt as the compressor.

Further, the control unit 19 determines a predetermined value of the angularity of the wobble plate 41 on the basis of various parameter values inputted thereto by the use of the aforementioned angularity table, and compares the predetermined angularity value thus determined with an angularity value calculated from the time interval ratio of generation of signal pulses from the sensor 48. When the two values do not coincide with each other, the control unit 19 supplies the pressure control valve 10 with a control signal for closing or opening same so as to bring the wobble plate 41 into a position corresponding to the above mentioned predetermined angularity.

As described above, according to the invention, it is not only possible by means of a single sensing means to detect an abnormality in the compressor speed attributed to a slip in the driving belt connected to the engine or the like to thereby protect other auxiliary equipment driven by the same driving belt, but also to sense the angularity of the wobble plate to thereby obtain a control signal for controlling the capacity of the compressor. Furthermore, the sensing means does not require addition of special parts unlike conventional sensing means, thus being simple in construction and low in manufacturing cost.

What is claimed is:

1. A variable capacity wobble plate compressor suitable for use with an associated internal combustion engine, comprising:

a housing;

a drive shaft arranged for rotational movement in said housing;

an electromagnetic clutch disposed between the engine and said drive shaft for transmitting rotational movement from the engine to said drive shaft when said clutch is engaged;

a wobble plate mounted on said drive shaft for swinging axially of said drive shaft as said drive shaft rotates;

pistons connected to said wobble plate for reciprocating motions in response to swinging of said wobble plate;

wherein a change in angularity of said wobble plate relative to said drive shaft causes a change in stroke of said reciprocating motions of said pistons so that the capacity of said compressor is varied;

a sensing element arranged on said wobble plate at a predetermined peripheral portion, said sensing element being moved along a predetermined orbital path together with swinging of said wobble plate;

sensor means arranged on said housing for generating an electric signal when said sensing element passes by said sensor means as said wobble plate swings;

control means for determining the rotational speed of said drive shaft and the angularity of said wobble plate on the basis of said electric signal from said sensor means;

said sensor means being so located as to align with a predetermined location between an axial center of said predetermined orbital path of swinging of said sensing element and an extreme possible point toward said pistons, when said wobble plate assumes a minimum angularity;

said control means including means coupled to said electromagnetic clutch for disengaging said clutch when the speed of said drive shaft is outside a predetermined range in relation to the rotational speed of the associated engine.

2. A variable capacity wobble plate compressor as claimed in claim 1, wherein said control means calculates a first time interval from the time a first pulse of said electric signal is generated as said sensing element moves from a first region extending toward said piston from said axial center of said predetermined orbital path to a second region extending away from said pistons from said axial center to the time an immediately following pulse of said electric signal is generated as said sensing element moves from said second region to said first region, and a second time interval from the time a third pulse of said electric signal is generated as said sensing element moved from said second region to said first region to the time a further following pulse of said electric signal is generated as said sensing element moves from said first region to said second region, calculates the ratio between said first and second time intervals, and determines the angularity of said wobble plate from the calculated time interval ratio.

3. A variable capacity wobble plate compressor as claimed in claim 1, wherein said control means calculates the rotational speed of said compressor from a number of pulses of said electric signal generated within a predetermined period of time.

4. A variable capacity wobble plate compressor, as claimed in claim 1, wherein said sensing element is formed of a magnetic material, and said sensor means is an electromagnetic induction type.

5. A variable capacity wobble plate compressor as claimed in claim 1, including an electromagnetic pressure control valve supported in said housing in operative relation With said wobble plate for controlling the degree of angularity of the plate relative to said drive shaft in response to a control signal, and wherein said control means includes means coupled to said pressure control valve for producing said control signal to obtain a desired compressor capacity.

6. A variable capacity wobble plate compressor suitable for use with an associated internal combustion engine, comprising:

a housing;

a drive shaft arranged for rotational movement in said housing;

an electromagnet clutch disposed between the engine and said drive shaft for transmitting rotational movement from the engine to said drive shaft when said clutch is engaged;

a wobble plate mounted on said drive shaft for swinging axially of said drive shaft as said drive shaft rotates;

pistons connected to said wobble plate for reciprocating motions in response to swinging of said wobble palte;

wherein a change in angularity of said wobble plate relative to said drive shaft causes a change in stroke of said reciprocating motions of said pistons so that the capacity of said compressor is varied;

a sensing element arranged on said wobble plate at a predetermined peripheral portion, said sensing element being moved along a predetermined orbital path together with swinging of said wobble plate;

sensor means arranged on said housing for generating an electric signal when said sensing element passes by said sensor means as said wobble plate swings;

control means for determining the rotational speed of said drive shaft and the angularity of said wobble plate on the basis of said electric signal from said sensor means;

said sensor means being so located as to align with a predetermined location between an axial center of said predetermined orbital path of swinging of said sensing element and an extreme possible point toward said pistons, when said wobble plate assumes a minimum angularity;

said control means further including means for controlling the degree of angularity of said wobble plate relative to said drive shaft and hence the capacity of said compressor responsive to the determined angularity of said wobble plate as determined on the basis of said electric signal from said sensor means.

7. A variable capacity wobble plate compressor as claimed in claim 6, further comprising an electromagnetic pressure control valve supported in said housing in operative relation with said wobble plate for controlling the degree of angularity of said wobble plate relative to said drive shaft in response to a control signal, and wherein said means for controlling of said control means is coupled to said pressure control valve for producing said control signal for thereby controlling said degree of angularity of said wobble plate and to thereby obtain a desired compressor capacity.

8. A variable capacity wobble plate compressor as claimed in claim 6, wherein said control means calculates a first time interval from the time a first pulse of said electric signal is generated as said sensing element moves from a first region extending toward said piston from said axial center of said predetermined orbital path to a second region extending away from said pistons from said axial center to the time an immediately following pulse of said electric signal is generated as said sensing element moves from said second region to said first region, and a second time interval from the time a third pulse of said electric signal is generated as said sensing element moves from said second region to said first region to the time a further following pulse of said electric signal is generated as said sensing element moves from said first region to said second region, calculates the ratio between said first and second time intervals, and determines the angularity of said wobble plate from the calculated time interval ratio.

* * * * *